United States Patent [19]

Barker

[11] 4,436,150

[45] Mar. 13, 1984

[54] BRIDGE PLUG

[75] Inventor: James M. Barker, Dallas, Tex.

[73] Assignee: Otis Engineering Corporation, Dallas, Tex.

[21] Appl. No.: 306,150

[22] Filed: Sep. 28, 1981

[51] Int. Cl.[3] ..... E21B 33/129

[52] U.S. Cl. ..... 166/131; 166/123; 166/134; 166/135; 166/137

[58] Field of Search ..... 166/119, 123, 131, 133, 166/134, 135, 136, 137, 138, 139, 211, 214, 216, 217, 237, 240

[56] References Cited

U.S. PATENT DOCUMENTS

| | | | |
|---|---|---|---|
| 2,532,418 | 12/1950 | Page | 166/212 |
| 3,011,558 | 12/1961 | Conrad | 166/217 |
| 3,244,233 | 4/1966 | Villalon, Jr. | 166/135 |
| 3,371,716 | 3/1968 | Current | 166/135 |
| 3,434,538 | 3/1969 | Kilgore et al. | 166/134 |
| 3,456,723 | 7/1969 | Current et al. | 166/131 |
| 3,602,305 | 8/1971 | Kisling | 166/134 |
| 4,059,150 | 11/1970 | Manderscheid | 166/123 |

*Primary Examiner*—Stephen J. Novosad
*Assistant Examiner*—William P. Neuder
*Attorney, Agent, or Firm*—H. Mathews Garland

[57] ABSTRACT

An inner mandrel extends the full length of the bridge plug, and carries a top sub at its upper end for latching engagement with a conventional overshot to retrieve the plug. A tubular outer mandrel is slidably mounted on the inner mandrel for limited axial sliding movement. A partial central bore in the inner mandrel and coacting ports adjacent the upper ends of the two mandrels provide a valved bypasss passage bridging the seal element. External slips are carried in a slip carrier axially fixed to the inner mandrel by shear screws. A tubular setting assembly consisting of a lower top wedge for expanding the external slips, an upper compression member, and an annular elastic seal element disposed for compression between the wedge and compression member, is yieldably secured to the outer mandrel by means of shear pins. Second yieldable shear pins couple the top wedge and compression member. The outer mandrel and tubular setting assembly are adapted to be coupled to electric line operated pressure setting apparatus for lowering the tool and for effecting upward pull of the mandrel and downward push of the setting assembly to set the tool. During the setting, the setting assembly first shears from the mandrel to set the top wedge and the seal element is then compressed. A bottom wedge assembly includes a collet wedge releasably coupled to the outer mandrel to be moved into engagement with the external slips, the setting movement of the collet wedge compressing a compression spring. For release of the bridge plug the coupling between the outer mandrel and collet wedge is released; and upward movement of the outer mandrel, provided by coupling to the inner mandrel, effects release of the collet wedges allowing the compression spring to retract the collet wedge, and picks up the compression sleeve and the top wedge to release the seal element and the top wedge.

29 Claims, 14 Drawing Figures

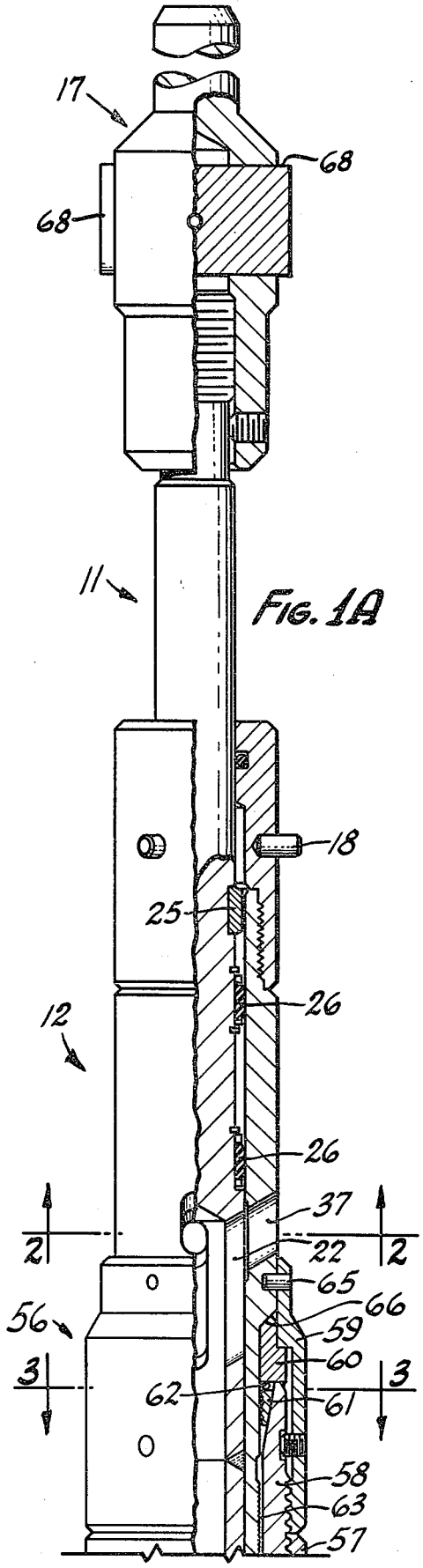
FIG. 1A
FIG. 1B
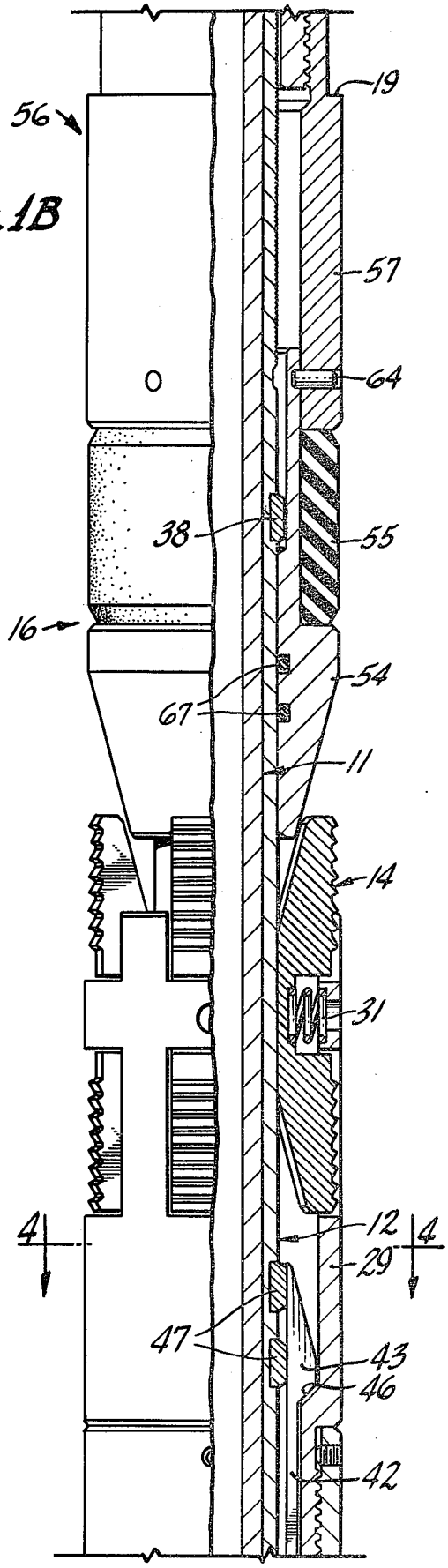

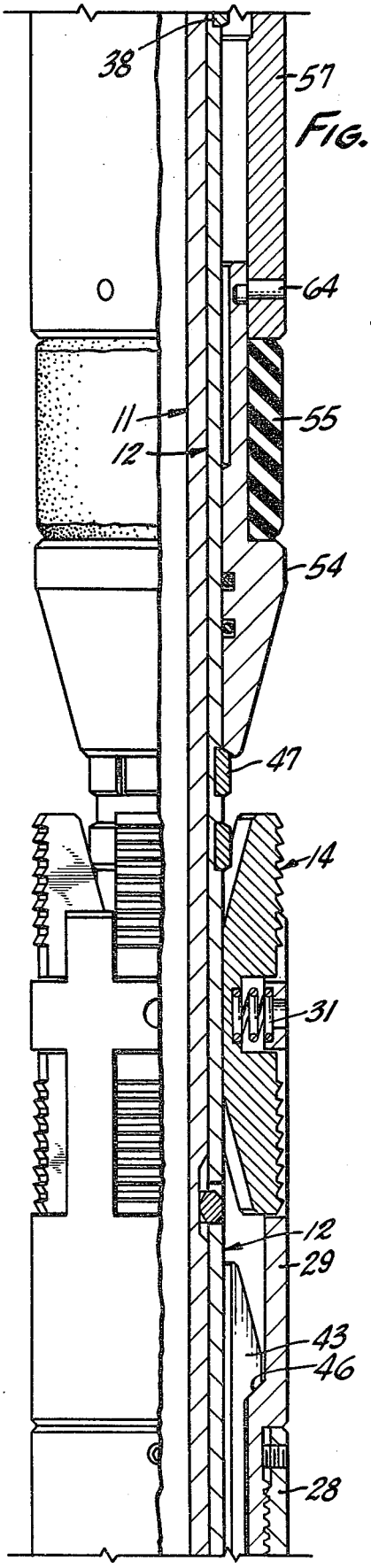
FIG. 8B
FIG. 8C
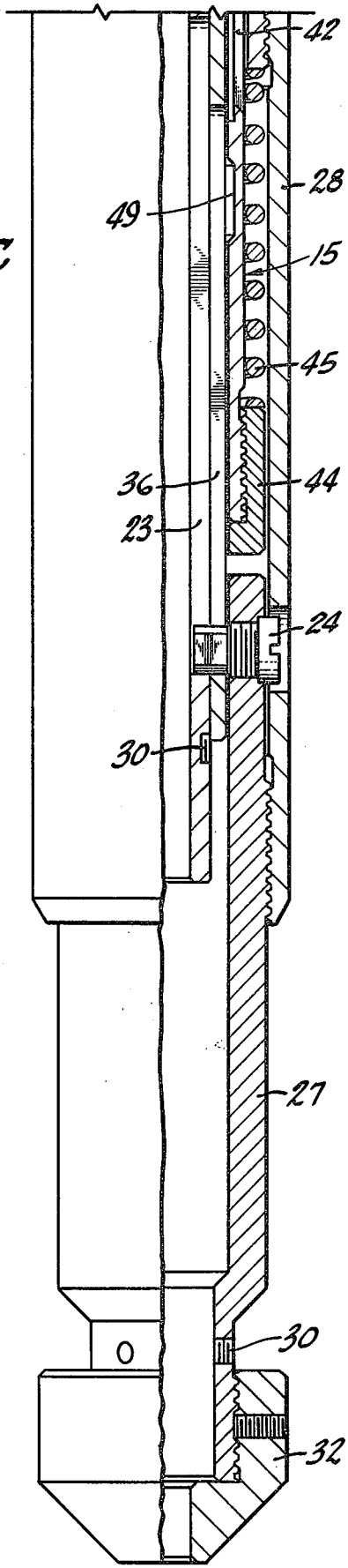

BRIDGE PLUG

This invention relates to a bridge plug for sealing a well bore; and more particularly to a retrievable bridge plug adapted to be set by a pressure setting apparatus employing electric line equipment.

An object of this invention is to provide a novel bridge plug having an internal bypass passage which is open during the running in and retrieval of the bridge plug, and which is closed when the bridge plug is set.

Another object of this invention is to provide such a bridge plug wherein the bypass passage is opened just prior to release to equalize the pressures across the bridge plug.

A further object of this invention is to provide a novel bridge plug which employs bi-directional slips to anchor the plug to the well bore, and which employs novel means for releasing the slips from the well bore.

Still another object of this invention is to provide a novel bridge plug employing bi-directional slips and top and bottom wedges for expanding the slips into engagement with the well bore, and novel means for releasing the top and bottom wedges to disengage the slips from the well bore.

A still further object of this invention is to provide a novel bridge plug having internal locking means for maintaining the plug in the set condition.

Another object of this invention is to provide a novel bottom wedge assembly for a bridge plug.

These objects are accomplished in an assembly which includes broadly an elongated inner mandrel having latch means at its upper end for engagement by a bridge plug overshot, and an outer elongated tubular mandrel mounted for limited axial movement relative to the inner mandrel. External slips are carried on the outer mandrel, to be expanded into engagement with the well bore. A tubular setting assembly, mounted for limited axial movement on the outer mandrel above the slips, includes an annular top wedge for engaging and expanding the slips, an annular elastic seal element adapted to be expanded into sealing engagement with the well bore, and a compression sleeve for exerting downward forces on those members. The outer mandrel and the setting assembly have means adjacent to their upper ends for engagement with a pressure setting apparatus to effect relative downward movement of the setting assembly and upward movement of the outer mandrel. In one aspect of the invention, the inner mandrel includes an internal passageway extending from its lower end to a point intermediate its ends, and the inner and outer mandrels have coacting ports effective to close said passageway when the bridge plug is set, and to open said passageway during the running in and during the release and retrieval of the bridge plug.

In another aspect of the invention, a bottom wedge for effecting the extension of the external slips includes a collet wedge mounted for limited axial movement on the outer mandrel, bearing means providing radial support for the collet wedge during the setting of the bridge plug, and an axial compression spring compressed by the collet wedge during the setting of the bridge plug. Means is provided during release of the bridge plug to displace the radial bearing means allowing inward movement of the bottom wedge, and axial release of the collet wedge from the slips under the urging of the compression spring.

The novel features and the advantages of the invention, as well as additional objects thereof, will be understood more fully from the following description when read in connection with the accompanying drawing.

DRAWINGS

FIGS. 1A, 1B and 1C are sequential elevation and sectional views of a bridge plug, according to the invention, in the running condition;

FIGS. 2 through 6 are transverse sectional views taken along the respective lines 2—2 through 6—6 of FIG. 1;

FIGS. 7A, 7B and 7C are sequential elevation and sectional views of the bridge plug of FIG. 1 in the set condition; and FIGS. 8A, 8B and 8C are sequential elevation and sectional views of the bridge plug of FIG. 1 in the retrieve condition.

DESCRIPTION OF THE PREFERRED EMBODIMENT

Figure 1C:
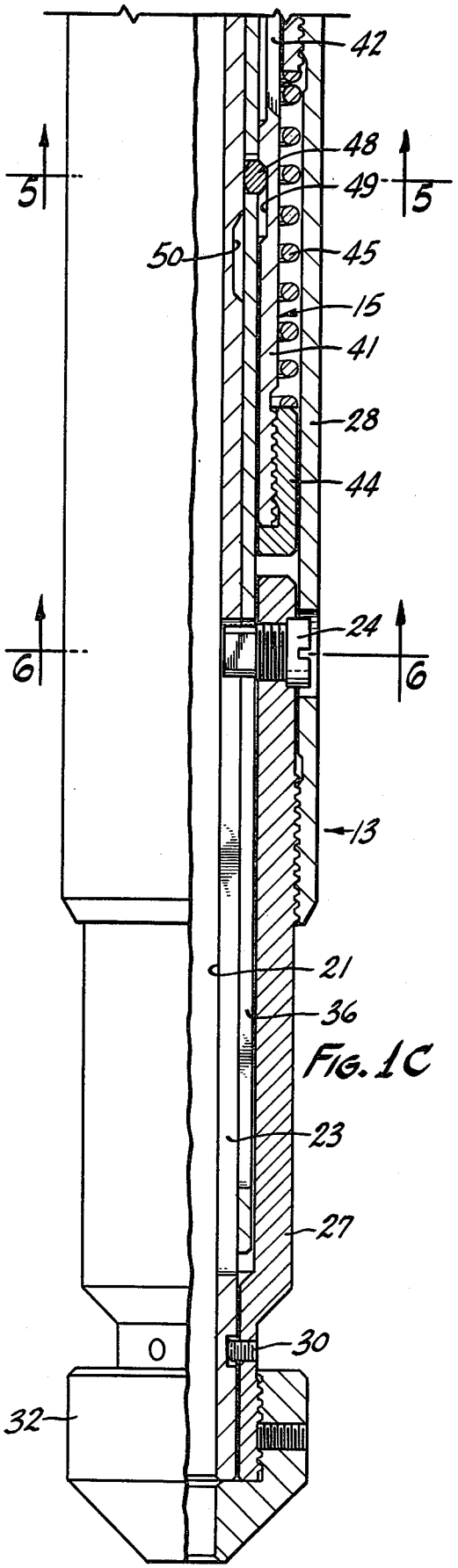
Figure 2:
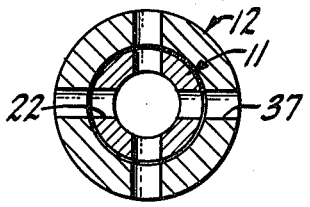
Figure 3:
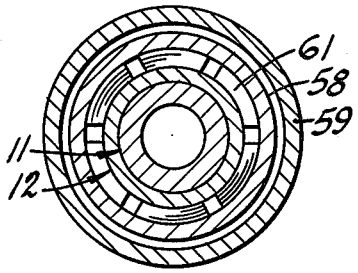
Figure 4:
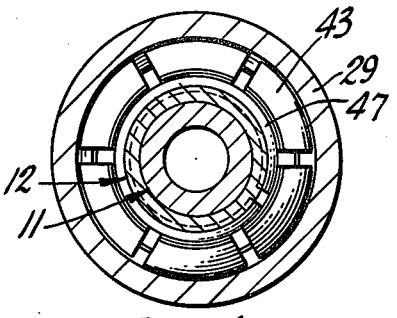
Figure 5:
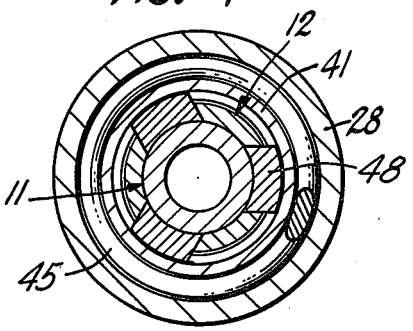
Figure 6:
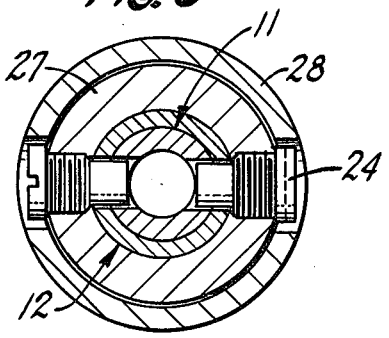

The drawings illustrate a preferred form of retrievable bridge plug according to the invention. FIGS. 1A, 1B and 1C illustrate the entire bridge plug assembly in the "running condition", that is its condition as the plug is being run into the well bore. The principal components of the bridge plug are an inner mandrel 11, an outer tubular mandrel 12 supported for limited axial movement on the inner mandrel, a tubular slip carrier 13 carrying radially extensible external slips 14 at its upper end, a tubular bottom wedge assembly 15 including collet wedges for engagement with the lower camming surfaces of the external slips, and a tubular setting assembly 16 mounted for limited axial movement on the outer mandrel 12, which setting assembly includes a top wedge for engagement with the upper camming surfaces of the slips 14 and an expansible annular seal element for sealing engagement with the well bore.

This bridge plug is designed to be run into the well bore and to be set by means of a pressure setting apparatus, sometimes referred to as a setting gun. One form of such pressure setting apparatus is illustrated in Conrad U.S. Pat. No. 2,799,343 entitled AUTOMATICALLY VENTED FLUID PRESSURE OPERATED APPARATUS. This apparatus includes an external setting sleeve or skirt 54 and an internal actuator mandrel 47 for coupling to the bridge plug as will be described. The setting apparatus is suspended from the surface by electric line apparatus, and includes an explosive charge which is detonated electrically at the desired time to effect relative downward or pushing movement of the setting sleeve 54 and relative upward or pulling movement of the actuator mandrel 47. For coupling the pressure setting apparatus to the bridge plug of the invention, the actuator mandrel of the setting apparatus would be coupled to the upper end of the outer mandrel 12 by means of a suitable adaptor sleeve (not shown); this coupling being made by shear pins 18. The setting sleeve of the pressure setting apparatus, possibly through an adaptor or extension sleeve, is configured to bear on the upward facing annular setting shoulder 19 of the setting assembly 16. For the running condition of the bridge plug, the positions of the components illustrated in FIGS. 1A, 1B and 1C are maintained by the coacting structure to be described; and the setting apparatus is in the described coacting relation to effect the setting of the bridge plug when it has been lowered to the desired depth within the well bore.

Referring now to the structural details of the bridge plug assembly, the inner mandrel 11 includes a top sub component 17 fixed to the upper end of the mandrel and which includes structure to be engaged by a complementary handling tool to effect the release and retrieval of the bridge plug after it has served its purpose. The inner mandrel is provided with an axial bore 21 extending from its lower end through a major portion of its length; and axially elongated ports 22 communicate the upper end of this bore with the exterior of the mandrel. The mandrel is provided, adjacent to its lower end, with a pair of axially elongated slots 23 configured to receive a pair of pins 24 of the slip carrier assembly 13, these slots and pins coacting to define certain limits of relative longitudinal movement of the components as will be described.

The slip carrier 13 is a tubular assembly consisting of a lower shear mandrel 27, an intermediate spring housing 28, and an upper slip carrier sleeve 29. The shear mandrel 27 is coupled to the inner mandrel 11 by means of shear screws 30 so that the entire slip carrier component is fixed for movement with the inner mandrel until those shear screws are ruptured. The above mentioned pins 24 are secured in the shear mandrel. The upper end of the slip carrier sleeve 29 is provided with a window structure for retaining the external slips 14, and for retaining the compression springs 31 which normally urge the slips 14 radially inwardly against the outer mandrel 12. A bottom cap 32 is fixed to the lower end of the shear mandrel and provides a shoulder for supporting the lower end of the inner mandrel in the running condition. This bottom cap prevents inadvertent shearing of the shear screws 30 in the event of an impact blow to the top of the inner mandrel 11.

The outer mandrel 12 is also provided with a pair of axially elongated slots 36 adjacent to its lower end, through which pass the pins 24 of the slip carrier. The outer mandrel is provided with circumferentially spaced ports 37 adjacent to its upper end, above the setting assembly 16, which ports communicate with the upper ends of the ports 22 of the inner mandrel in the illustrated relative positions of the inner and outer mandrels for the running condition. In this condition then the bore 21 and the ports 22 and 37 define an internal bypass passage through the bridge plug, to facilitate the running in of the bridge plug through a well bore which is filled with fluid.

The bottom wedge assembly 15 includes a collet wedge for coaction with the lower cam surfaces of the external slips 14. The collet wedge is a tubular member having an annular base portion 41 at its lower end, circumferentially spaced axially extending fingers 42 projecting upwardly and carrying wedges 43 at the distal ends. An annular spring cap 44 is threadedly secured to the base end, and provides an external upward facing shoulder for a helical compression spring 45. The slip carrier sleeve 29 of the slip carrier assembly 13 provides an interior annular downward facing bearing shoulder for the upper end of the compression spring 45. The spring 45 normally urges the bottom wedge assembly to its lower limit position which is defined by the bases of the wedges 43 which engage an internal annular shoulder 46 on the slip carrier sleeve.

It will be seen that the flexible fingers 42 and the wedges 43 of the collet wedge are radially spaced from the outer wall of the outer mandrel 12 to allow inward flexing of these fingers and wedges. It will also be seen that the wedges 43 are maintained in this spaced relationship by a pair of bearing rings 47 associated with the outer mandrel. These bearing rings may be in the form of snap rings retained in suitable annular grooves in the outer mandrel, and limit the radially inward movement of the wedges 43 during certain conditions of the bridge plug including the running condition now being described. The bottom wedge assembly 15 is mounted for very limited axial movement relative to the outer mandrel 12 by means of lugs 48 which are confined in respective periferally spaced openings in the wall of the outer mandrel. As seen, the tubular wall of the outer mandrel is closely confined between the inner mandrel and the base portion of the collet wedge; and these lugs are larger in lateral dimension than the thickness of the outer mandrel wall. Accordingly, to accommodate the lugs 48, an internal annular recess 49 is provided in the base portion 41 of the collet wedge; and the coaction of these lugs and recess provide the axial coupling of the outer mandrel and bottom wedge assembly during certain conditions. It will also be seen that an external annular recess 50 is provided in the inner mandrel 11 for coaction with these lugs 48 during the release and retrieve conditions of the bridge plug to be described.

The setting assembly 16 is a stacked tubular assembly consisting of a lower top wedge 54, an intermediate seal element 55, and an upper compression sleeve 56. The lower end of the top wedge 54 forms an enlarged head having a conoid surface for coaction with the inclined cam surfaces of the external slips 14, and a reduced diameter shank at its upper end. The junction between the shank and head defines an upward facing annular bearing shoulder for the seal element 55. A pair of resilient seal rings 67 seal between the top wedge 54 and the outer mandrel 12, and are preferably O-rings carried in suitable internal grooves in the top wedge as shown.

The compression sleeve 56 is an assembly of several parts including a lower element retainer 57, an internal slip housing 58, an overshot ring 59, and a slip retainer 60. The slip housing 58 defines a frusto-conical bowl at its upper end, enclosed by the slip retainer 60, for confining wedge-shaped internal slips 61. The bowl is configured that relative upward movement of the compression sleeve 56 will cam the slips into locking engagement with the exterior surface of the outer mandrel 12; and an O-ring 62 provides an elastic means normally urging the internal slips 61 into engagement with the outer mandrel surface. A portion of this mandrel surface is provided with serrations 63; and these serrations may be in the form referred to as a "phonograph finish" for coaction with a similar serrated surface on the inner faces of the internal slips 61.

The lower end of the compression sleeve provides a skirt which overlaps and receives a portion of the upper end of the top wedge shank; and the lower end face of this skirt defines a downward facing bearing shoulder for the seal element 55. This seal element is an annular elastic member which is, then, confined between the confronting shoulders of the top wedge and the compression sleeve and, when compressed axially, will expand radially outward into sealing engagement with the well bore. The top wedge 54 and compression sleeve 56 are initially locked together by means of shear pins 64 so that, during this running condition of the bridge plug, the entire setting assembly is an integral rigid assembly. This setting assembly is secured to the outer mandrel 12 by means of another set of shear pins 65, and therefore moves with the outer mandrel during this running condition. The outer mandrel is also provided with a downward facing bearing shoulder 66 coacting with a mating internal shoulder of the compression sleeve 56, to prevent upward movement of the compression sleeve relative to the outer mandrel.

Other elements of the structure which function in operating steps to be described, include a bearing ring 25 mounted in an annular groove adjacent to the upper end of the inner mandrel 11 for coaction with a suitable internal shoulder at the upper end of the outer mandrel 12 to enable lifting of the outer mandrel by the inner mandrel in a subsequent operation. Axially spaced annular resilient seal rings 26 are mounted on the inner mandrel, to seal off the outer mandrel ports 37 in another condition of the bridge plug. An external bearing ring 38 mounted in a annular groove in the outer mandrel 12 within the setting assembly 16 coacts with an internal shoulder of the compression sleeve to lift ahd support that sleeve during the release and retrieve conditions.

OPERATION

The operation of the bridge plug will now be described. The shear pins 65 and 64 associated with the setting assembly, the shear pins 18 for coupling the bridge plug to the pressure setting apparatus, and the shear screws 30 associated with the slip carrier assembly 13 are all designed to shear during the operation of the tool. The three sets of shear pins will rupture during the setting operation to be described; and, by way of example, the shear pins 65 will rupture under an applied force of 5000 pounds, the shear pins 64 will rupture under an applied force of 10,000 pounds, and the shear pins 18 will rupture under a force of 30,000 pounds. The shear screws 30 will rupture during the release operation, under an applied force of 20,000 to 30,000 pounds for example.

During the running of the bridge plug, as has been described, the tool is suspended by the pressure setting apparatus coupled to the outer mandrel 12 by the shear pins 18; and during this condition the components have the relative positions illustrated in FIGS. 1A, 1B and 1C. The collet wedge 41–44 is locked to the outer mandrel by the lugs 48 and, in turn, supports the slip carrier 13 through the compression spring 45. The slip carrier, in turn, supports the inner mandrel 11 through the shear screws 30. To assure the proper alignment of the bypass ports 22 and 37, it may be desirable to have a more positive coupling between the outer mandrel and the inner mandrel; and such coupling may be provided, for example, by appropriately placed shear pins directly coupling the inner and outer mandrels, or by appropriately placed shear pins directly coupling the collet wedge and the slip carrier. Such shear pins would be designed to rupture during the setting operation.

Figure 7A:
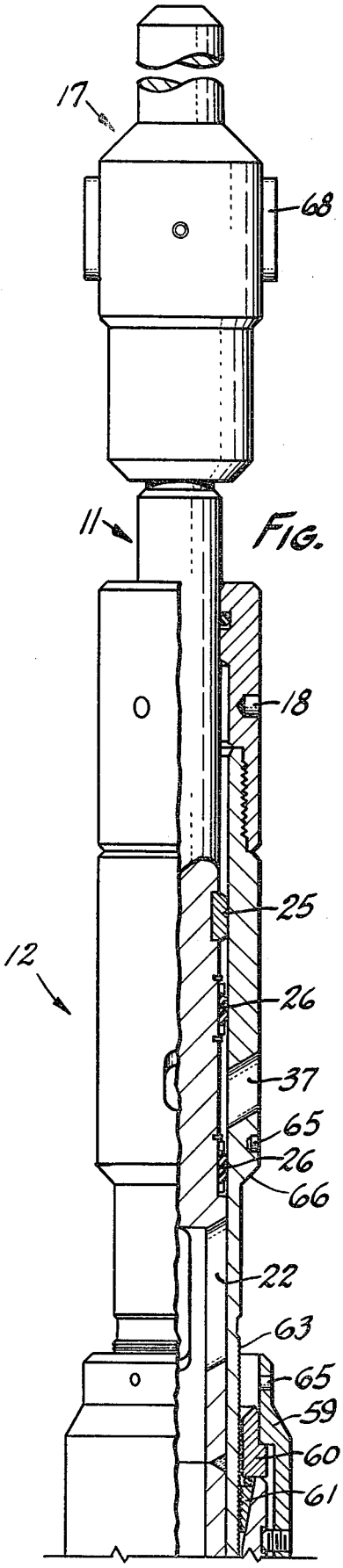
Figure 7B:
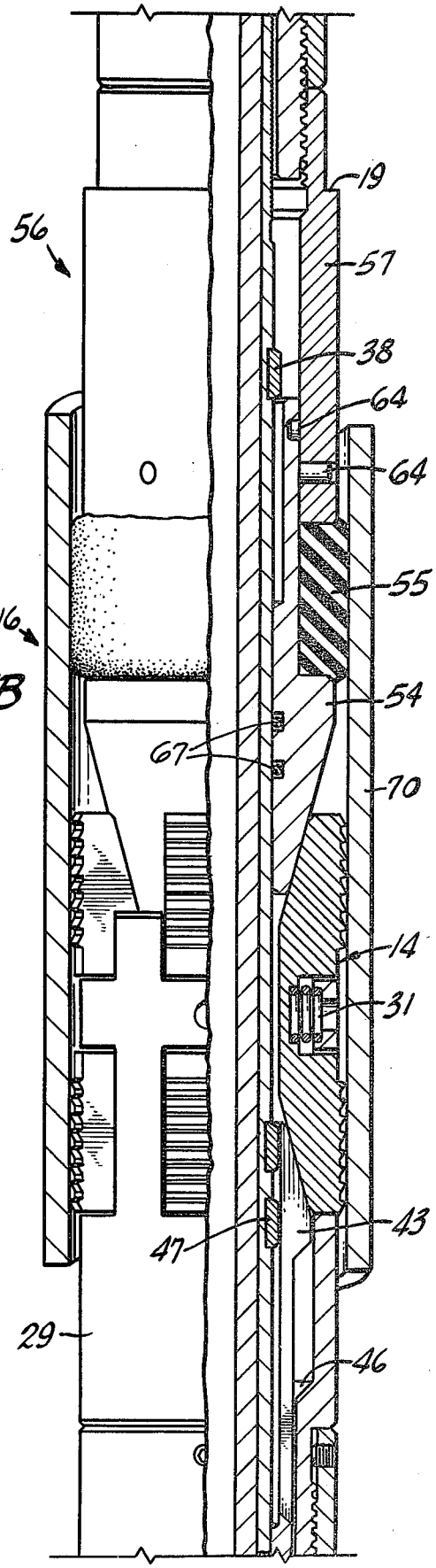
Figure 7C:
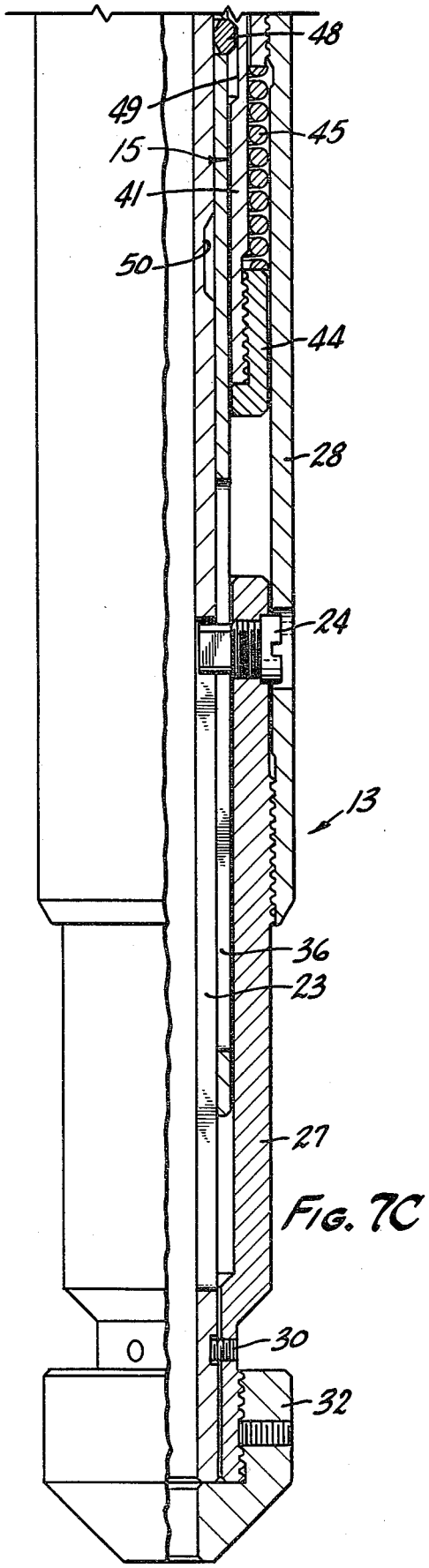

When the bridge plug has been lowered to the desired depth by the electric line apparatus, the plug is set by firing the pressure setting apparatus; and this apparatus produces a force in excess of 30,000 pounds acting to pull up on the outer mandrel 12 and push down on the setting assembly 16. The shear pins 65 rupture first to separate the setting assembly from the outer mandrel; and this results in simultaneous movement of the top wedge 54 and bottom wedges 43 toward the external slips 14, to cam the slips radially outward into locking engagement with the well bore, represented by a well casing 70 shown in FIG. 7B. The outer mandrel is moved upward relative to the slips, and carries with it the bottom wedge assembly through the coupling of the lugs 48 and the recesses 49. The relative positions of the bearing rings 47 and top wedges 43 is maintained to effect the outward camming of the external slips.

Shortly following the rupture of the shear pins 65 and the setting of the external slips 14, the shear pins 64 rupture to separate the compression sleeve 56 from the top wedge 54; and this effects the axial compression of the seal element 55 to expand that element into sealing engagement with the well bore. The relative movement of the compression sleeve 56 and outer mandrel 12 has carried the internal slips 61 to the area of the outer mandrel phonograph finish 63 to lock the compression sleeve against subsequent upward movement relative to the outer mandrel. Upward force applied by the compressed seal element serves to wedge the internal slips more firmly into locking engagement with the outer mandrel.

The upward movement of the bottom wedge assembly 15 relative to the slip carrier assembly 13 effects the compression of the spring 45 which then exerts a force of 100 pounds for example urging the bottom wedge assembly downward. Since the inner mandrel 11 is locked to the slip carrier assembly by the shear screws 30, there is some upward movement of the outer mandrel relative to the inner mandrel, this movement being limited by the coupling of the outer mandrel to the bottom wedge assembly 15. This relative movement positions the outer mandrel ports 37 between the axially spaced seal rings 26 of the inner mandrel, so that communication between the inner mandrel bore 21 and the exterior of the plug above the seal element 55 is closed enabling the tool to perform its function of plugging the well bore. At the completion of the setting operation, the force imparted by the pressure setting apparatus ruptures the shear pins 18 to separate that apparatus from the bridge plug. The pressure setting apparatus is then withdrawn from the well by the electric line apparatus to enable the desired well servicing or other operations to be performed.

To accomplish the release and retrieval of the bridge plug from the well bore, a handling tool or fishing tool is lowered into the well on tubing to engage and latch onto the top sub 17 of the inner mandrel 11. This handling tool may be, for example, a conventional bridge plug overshot which coacts with the complementary top sub 17. The top sub includes an enlarged head having a rectangular member secured within a transverse slot, the rectangular member projecting laterally to define opposed lifting lugs 68 to be received in complementary internal slots of the overshot to effect the locking engagement. To effect this locking engagement, the overshot is first lowered to a point where the lower end thereof engages and rests on an annular shoulder provided by the overshot ring 59; and the lessening of the suspended load signals the operator that the overshot is in condition for locking engagement with the bridge plug.

To begin the release operation, a lifting force is applied to the inner mandrel 11 through the overshot; and since the slip carrier assembly 13 is locked against movement, a force sufficient to rupture the shear screws 30 must be applied to separate the inner mandrel from the slip carrier assembly. The inner mandrel moves upward alone until it picks up the outer mandrel through engagement of the bearing ring 25 with the confronting shoulder at the upper end of the outer mandrel. When this occurs the relative positions of the inner and outer mandrel are such that the outer mandrel ports 36 are again communicated with the inner mandrel ports 22 whereby the ports and inner mandrel bore 21 provide an equalizing passage to equalize the pressure across the bridge plug seal element 55. This passageway then remains open to function as a bypass passage to facilitate the retrieval of the bridge plug through the fluid filled well bore. Additionally, in this relative position of the inner and outer mandrels, the inner mandrel annular recess 50 is aligned laterally with the lugs 48; and this has the effect of releasing the lugs 48 from the annular recess 49 of the bottom wedge assembly to new permit movement of the bottom wedge assembly relative to the outer mandrel.

The outer mandrel now moves upward relative to the slips and the bottom wedge assembly. The outer mandrel moves upward relative to the compression sleeve 56, allowing the compression sleeve to remove the holding force from the seal element 55 and the top wedge 54. Also, with the initial upward movement of the outer mandrel, the bearing rings 47 are moved out of bearing engagement with the collet wedges 43, allowing the collet fingers 42 and the wedges to flex inwardly away from wedging engagement with the external slips 14. The spring 45 then urges the bottom wedge assembly 15 downward relative to the external slips to the limit position determined by the shoulder 46 and illustrated in FIG. 8B.

Figure 8A:
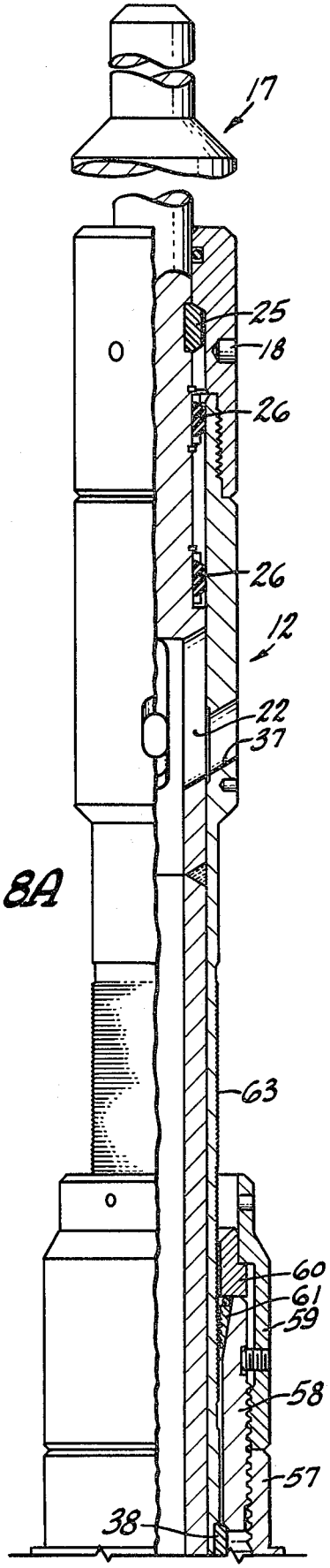

With continued upward movement of the outer mandrel, its bearing ring 38 engages the shoulder defined by the internal slip housing 58 of the compression sleeve 56 to carry that compression sleeve assembly upward; and immediately thereafter the upper support ring 47 engages the lower end of the top wedge 54 to carry that top wedge upward out of engagement with the external slips 14. The external slips, then, are completely free to be radially retracted by the respective slip springs 31 out of engagement with the well bore. With continued upward movement of the inner and outer mandrels, or the downward movement of the slip carrier assembly 13 and slips 14 which may occur when the slips are released, the bottom ends of the respective mandrel slots 23 and 36 which are now laterally aligned, will engage the pins 24 of the slip carrier assembly to carry that assembly. All components of the bridge plug are now supported from the inner mandrel in the retrieve condition as illustrated in FIGS. 8A, 8B and 8C; and the bridge plug and supporting tubing may be withdrawn from the well.

What has been described is a unique retrievable bridge plug for plugging a well bore, which is adapted to be lowered and set by electric line apparatus and associated pressure setting apparatus, and which is adapted to be retrieved by the conventional bridge plug overshot supported at the lower end of well tubing.

A particular feature of the invention is the provision of an internal bypass passageway, bypassing the seal element of the bridge plug, which is open during the running in operation of the bridge plug to facilitate this operation through a fluid filled well bore. As a function of the setting operation, this bypass passage is closed to enable the bridge plug to perform its function. As an incident of the release operation of the bridge plug, this bypass passage is again opened prior to release of the seal element to equalize any differential pressure across the seal element; and the bypass passage remains open during the subsequent retrieval operation to again facilitate movement of the bridge plug through the fluid filled well bore.

Another important feature of the invention is the bottom wedge assembly including collet wedges and the associated spring, which spring is compressed during the setting of the plug and the engagement of the collet wedges with the external slips, and which spring later functions to effect the displacement of the collet wedges from the external slips to, in turn, effect the release of the slips from the well bore.

While the preferred embodiment of the invention has been illustrated and described, it will be understood by those skilled in the art that changes and modifications may be resorted to without departing from the spirit and scope of the invention.

I claim:

1. A bridge plug for a well bore comprising an elongated linear mandrel having an internal bypass passage opening to the lower end of said mandrel, with the upper end of said passage terminating in lateral ports opening to the exterior of said mandrel;

an elongated tubular outer mandrel mounted for limited axial movement on said inner mandrel;

external slips carried on said outer mandrel for limited axial movement relative thereto, and disposed to be expanded into setting engagement with a well bore;

a tubular setting assembly mounted for axial movement on said outer mandrel above said slips; said setting assembly including a lower top wedge to engage and expand said slips, an upper compression member, and an annular elastic seal element disposed to be compressed between said top wedge and said compression member and thereby expanded radially into sealing engagement with the well bore;

said outer mandrel and said compression member having means for coupling to a setting apparatus, for concurrent upward pull of said outer mandrel and downward push of said setting assembly to effect the setting of said bridge plug in a well bore;

coupling means for coupling said inner mandrel to said tubular setting assembly for downward movement therewith relative to said outer mandrel during the setting of said bridge plug;

said outer mandrel having lateral ports for selective communication with said inner mandrel ports to open and close said bypass passage;

yieldable coupling means coupling axially said inner and outer mandrels during the running of said plug into the well bore, to maintain said ports in communication to open said bypass passage; said yieldable coupling means yielding and said outer mandrel being moved upward relative to said inner mandrel, during the setting of said bridge plug, to move said ports out of communication to close said bypass passage.

2. A bridge plug as set forth in claim 1 said inner mandrel having means at its upper end for coupling to a retrieving tool;

said outer mandrel being movable upward relative to said tubular setting assembly to effect the release of said assembly from the well bore;

said inner mandrel being raised by a retrieving tool relative to said outer mandrel to effect the release of said bridge plug; and means limiting the upward movement of said inner mandrel relative to said outer mandrel to effect communication of said mandrel ports and open said bypass passage to equalize pressure across said bridge plug seal prior to release thereof.

3. A bridge plug as set forth in claim 1 said top wedge comprising an elongated tubular member having a lower wedge head including a conoid surface diverging outwardly from the lower end thereof, an upper reduced diameter shank, and an annular upward facing shoulder formed by said shank and said head;

said seal element being slidably mounted on said shank, with said shoulder providing a lower bearing surface therefor;

the lower end of said compression member receiving the upper end of said wedge shank, and being configured for relative axial sliding movement; yieldable coupling means axially coupling said top wedge shank and said compression member; and the lower end face of said compression member providing an upper bearing surface for said seal element.

4. A bridge plug as set forth in claim 3 second yieldable coupling means axially coupling said compression member to said outer mandrel; said second yieldable means yielding to a lesser axial force than said first named yieldable means, whereby said setting assembly is first urged downwardly relative to said outer mandrel to urge said slips outwardly into locking engagement with the well bore, and whereby said seal element is subsequently compressed between said wedge head and said compression member and thereby expanded into sealing engagement with the well bore.

5. A bridge plug as set forth in claim 1 said outer mandrel and said compression member having coacting locking means effective to prevent upward movement of said compression member relative to said outer mandrel, and thereby to maintain said slips and said seal element in the set condition.

6. A bridge plug as set forth in claim 5 said locking means permitting upward movement of said outer mandrel relative to said compression member.

7. A bridge plug as set forth in claim 6 said locking means comprising a serrated surface on the exterior of said outer mandrel; said compression sleeve having an internal, frusto-conical wedge chamber confronting the outer surface of said outer mandrel, for confining locking wedges therein; said locking wedges having internal serrated faces for coaction with said serrated surface of said outer mandrel; and means for urging said wedges into locking engagement with said mandrel serrated surface.

8. A bridge plug as set forth in claim 2 said external slips being supported in a slip carrier for relative radial movement into and out of engagement with said well bore; said slip carrier comprising an annular member surrounding said outer mandrel and mounted thereon for relative axial movement;

yieldable coupling means coupling axially said slip carrier and said inner mandrel; said yieldable coupling means being yieldable in response to an axial load applied to said inner mandrel by a retrieving tool, to release said inner mandrel from said slip carrier and allow relative movement thereof.

9. A bridge plug as set forth in claim 8 said outer mandrel and said inner mandrel having coacting automatic latch means, engageable upon movement of said inner mandrel upward to a predetermined position relative to said outer mandrel, wherein said outer mandrel and inner mandrel are locked together axially and wherein said mandrel ports are again positioned in communication with each other to open said bypass passageway.

10. A bridge plug as set forth in claim 9 said outer mandrel having abutment means for engagement with said top wedge, whereby relative upward movement of said inner and outer mandrels disengages said top wedge from said slips to allow contraction and release thereof from the well bore.

11. A bridge plug for a well bore comprising an elongated mandrel;

external slips carried on said mandrel in an annular slip carrier mounted for relative axial movement; said slips being disposed in said carrier to be urged radially outward from said mandrel into engagement with a well bore;

a bottom wedge assembly carried on said mandrel, having wedges at its upper end for engaging and urging said slips radially outward;

a tubular setting assembly mounted for axial movement on said mandrel, including a top wedge at its lower end for engaging and urging said slips radially outward;

said mandrel and said setting assembly having means for coupling to a setting apparatus, to produce relative upward movement of said mandrel and downward movement of said setting assembly, to thereby effect said engagement of said bottom and top wedges with said slips to effect the setting thereof;

said bottom wedge assembly comprising: an annular wedge member having said wedges at its upper end, and having means providing an upward facing annular bearing shoulder; said slip carrier providing a downward facing annular bearing shoulder; and a helical compression spring confined between said shoulders;

releasable coupling means coupling said wedge member axially to said mandrel;

said compression spring being compressed during the setting of said slips, through movement of said mandrel and coupled wedge member relative to said slips;

means for releasing said releasable coupling means, thereby allowing said compression spring to move said wedge member and associated wedges away from said slips and allow release of said slips.

12. A bridge plug as set forth in claim 11 said annular wedge member having a base and a plurality of circumferentially spaced spring fingers extending upwardly from said base, with the distal ends of said fingers being configured as wedges;

said spring fingers and wedges of said wedge member being spaced radially from the outer wall of said mandrel;

radially extending bearing means on said mandrel for supporting said wedges in said radially spaced relation relative to the wall of said mandrel;

and said bearing means being movable upwardly with said mandrel, relative to said wedge member and said slips, to enable relative radial inward movement of said wedges to release said wedges from said slips.

13. A bridge plug as set forth in claim 12
said bearing means comprising at least one ring member carried in an annular groove in said mandrel.

14. A bridge plug as set forth in claim 10
spring means normally urging said slips radially inward relative to said mandrel.

15. A bridge plug as set forth in claim 10
coacting locking means on said mandrel and said tubular setting assembly, responsive to relative downward movement of said setting assembly to lock said assembly against subsequent relative upward movement; and means for releasing said coacting locking means, responsive to upward movement of said mandrel relative to said setting assembly, to release said top wedge from said slips.

16. A bridge plug as set forth in claim 10
said tubular setting assembly including said lower top wedge, an upper compression member, and an annular elastic seal element disposed to be compressed between said top wedge and said compression member and thereby expanded radially into sealing engagement with the well bore.

17. A bridge plug as set forth in claim 16
said top wedge comprising an elongated tubular member having a lower wedge head including a conoid surface diverging outwardly from the lower end thereof, an upper reduced diameter shank, and an upward facing annular shoulder formed by said shank and said head;
said seal element being slidably mounted on said shank, with said shoulder providing a lower bearing surface therefor;
the lower end of said compression member receiving the upper end of said wedge shank, and being configured for relative axial sliding movement; yieldable coupling means axially coupling said top wedge shank and said compression member; and the lower end face of said compression member providing an upper bearing surface for said seal element.

18. A bridge plug as set forth in claim 17
second yieldable coupling means axially coupling said compression member to said mandrel; said second yieldable coupling means yielding to a lesser axial force than said first named yieldable means, whereby said setting assembly is first urged downwardly relative to said mandrel to urge said slips outwardly into locking engagement with the well bore, and whereby said seal element is subsequently compressed between said wedge head and said compression member and thereby expanded into sealing engagement with the well bore.

19. A bridge plug as set forth in claim 16
coacting locking means on said mandrel and said tubular setting assembly, responsive to relative downward movement of said setting assembly to lock said assembly against subsequent relative upward movement;
said coacting locking means comprising a serrated surface on the exterior of said mandrel; said compression member having an internal, frusto-conical wedge chamber confronting the outer surface of said outer mandrel, for confining locking wedges therein; said locking wedges having internal serrated faces for coaction with said serrated surface of said mandrel; and elastic means for urging said wedges into locking engagement with said mandrel serrated surface.

20. A bridge plug as set forth in claim 11
said bearing means being effective, upon further upward movement of said mandrel relative to said slips, to engage and move said top wedge upward relative to said slips.

21. A bridge plug as set forth in claim 16
radially extending bearing means mounted on said mandrel, movable upwardly with said mandrel relative to said slips, to engage and move said compression member upwardly to allow contraction of said seal element and release thereof from the well bore.

22. A bridge plug as set forth in claim 11
said elongated mandrel comprising a tubular outer mandrel;
a second inner mandrel disposed within said outer mandrel for relative axial movement; said inner mandrel having means at its upper end for coupling to an overshot to effect the release and withdrawal of said bridge plug from the well bore;
releasable coupling means coupling said inner mandrel and said slip carrier, for maintaining said inner mandrel below a predetermined axial position relative to said outer mandrel;
automatically engageable coupling means, engageable in response to upward movement of said inner mandrel relative to said outer mandrel beyond said predetermined position, for coupling said inner mandrel to said outer mandrel upon said upward movement; said automatic coupling means being effective to release simultaneously said releasable coupling means between said outer mandrel and said wedge member;
said releasable coupling means for said inner mandrel and said slip carrier being yieldable upon the application of predetermined upward force to said inner mandrel, whereby subsequent upward movement of said inner mandrel effects the coupling to said outer mandrel and the coincident uncoupling of said outer mandrel and said jaw member to allow the release of said jaw member from said slips under the impetus of said compression spring.

23. A bridge plug as set forth in claim 22
radially extending bearing means mounted on said outer mandrel, movable upwardly with said outer mandrel relative to said slips to engage and move said top wedge upwardly relative to said slips.

24. A bridge plug as set forth in claim 23
said tubular setting assembly including said lower top wedge, an upper compression member, and an annular elastic seal element disposed to be compressed between said top wedge and said compression member and thereby expanded radially into sealing engagement with the well bore;
second radially extending bearing means mounted on said outer mandrel, movable upwardly with said outer mandrel relative to said slips to engage and move said compression member upwardly to allow contraction of said seal element and release thereof from the well bore.

25. In a retrievable bridge plug including an elongated mandrel, external slips carried on said mandrel for relative axial movement, and said slips being disposed to be urged radially outwardly from said mandrel into engagement with a well bore; a bottom wedge assembly carried on said mandrel, comprising a wedge member having an annular base, a plurality of circumferentially spaced spring fingers extending upwardly from said base, and the distal ends of said fingers being configured as wedges to engage and urge said slips radially outward;

means on said mandrel for holding said finger distal ends against radial inward movement toward said mandrel at a first lower mandrel position and movable with said mandrel to a second upper mandrel position for releasing said finger ends for radial inward movement;

releasable coupling means coupling said wedge member axially to said mandrel;

means on said base providing an upward facing annular bearing shoulder; means axially coupled to said slips providing a downward facing annular bearing shoulder; a helical compression spring confined between said shoulders;

said compression spring being compressed during the setting of said slips, through relative upward movement of said mandrel and coupled wedge member;

and means for releasing said releasable coupling means, thereby allowing said compression spring to move said wedge member and associated wedges out of engagement with said slips.

26. A wedge assembly as set forth in claim 25 said spring fingers and wedges of said wedge member being spaced radially from the outer wall of said mandrel;

radially extending bearing means on said mandrel for supporting said wedges in said radially spaced relation relative to the wall of said mandrel;

and said bearing means being movable upwardly with said mandrel, relative to said wedge member and said slips, to enable relative radial inward movement of said wedges to release said wedges from said slips.

27. A wedge assembly as set forth in claim 26 said bearing means comprising at least one ring member carried in an annular groove in said mandrel.

28. A wedge assembly as set forth in claim 25 said slips being carried in a tubular slip carrier mounted for axial movement relative to said mandrel; said slip carrier providing said downward facing bearing shoulder for said compression spring.

29. A wedge assembly as set forth in claim 25 spring means normally urging said slips radially inward relative to said mandrel.

* * * * *